United States Patent [19]

Warsinske

[11] 4,289,270

[45] Sep. 15, 1981

[54] PORTABLE CONCENTRATOR

[75] Inventor: Arthur E. Warsinske, Spokane, Wash.

[73] Assignee: Jack G. Riley, Spokane, Wash.

[21] Appl. No.: 122,031

[22] Filed: Feb. 19, 1980

[51] Int. Cl.[3] ..... B04B 1/04; B04B 7/12

[52] U.S. Cl. ..... 233/27

[58] Field of Search ..... 233/27, 1 R, 1 E, 2, 233/3, 16; 209/485, 453, 445, 44

[56] References Cited

U.S. PATENT DOCUMENTS

| | | | |
|---|---|---|---|
| 942,663 | 12/1909 | Rachelman | 209/485 |
| 1,190,466 | 7/1916 | Schiffrle | 233/20 R |
| 1,413,289 | 4/1922 | Clift | 209/199 |
| 2,022,926 | 12/1935 | Schlank | 233/27 |
| 2,585,753 | 2/1952 | Drury | 233/27 |
| 2,649,202 | 8/1953 | Jones | 209/159 |
| 2,858,064 | 10/1958 | Clow | 233/27 |

*Primary Examiner*—Robert W. Jenkins

*Attorney, Agent, or Firm*—Wells, St. John & Roberts

[57] ABSTRACT

A portable concentrator is described for separating particulates such as valuable metals and gems that will separate from other material due to differential in specific gravity. The concentrator makes use of an upwardly open bowl. The bowl is removable from its mounting frame and is rotated by frictional engagement with a rotatable wheel. The bowl receives a slurry mixture and spreads it radially toward its upwardly inclined side walls. A removable pan is positioned in the bottom of the bowl to initially receive the slurry mixture. The pan includes a convex surface for directing received particulates radially outward to an annular pocket formed between the bottom wall of the pan and an annular flange member. Heavy particulate gathers in the pocket. The lighter tailings migrate up the wall of the bowl and over its edge. The tailings are received within a spillway of the housing that encircles the bowl and is drained off onto an elongated riffle plate.

12 Claims, 4 Drawing Figures

PORTABLE CONCENTRATOR

BACKGROUND OF THE INVENTION

The present invention relates to particulate concentrating devices, particularly such devices using centrifugal force to influence separation of heavy particulate fines from a gangue.

The rising value of rare minerals such as gold and silver has revitalized interest in prospecting, especially by individual "weekend" prospectors. The most popular method currently used by individual prospectors is hand panning. This process is extremely slow and its effectiveness varies with experience and the patience of the prospector. This, together with the low precious metal content of most "worked over" areas results in very little chance of the prospector profiting by his efforts and time.

It therefore becomes desirable to make use of apparatus that can process large volumes of material in short periods of time. Such apparatus should also be effective in separating the valued material from the gangue. It is desirable that such apparatus be fully portable and affordable to "weekend" prospectors.

Various attempts have been made to provide an efficient, if not portable, mineral concentrator throughout the years. In 1916, C. Shifferle was granted U.S. Pat. No. 1,190,466 for an apparatus that separated material of different specific gravities. The apparatus included a rotating bowl for receiving the raw material and spreading it by centrifugal force into pockets along a cylindrical upright wall. Water was urged inwardly through the wall to prevent packing of the material within the pockets. The machine had to be stopped periodically to clean the pockets. An alternate form allows continuous operation with a discharge arrangement for the collected fines. A similar concentrator is discharged in U.S. Pat. No. 2,649,202 to Jones. Neither patent discloses a bowl that is easily removable from its associated supportive framework, or an insert that is receivable within the bowl and can be removed for cleaning and replacement.

More portable apparatus is disclosed in the 1922 U.S. Pat. No. 1,413,289 to Odell et al. A hand cranked rotating drum separates material as it moves up the inclined surface of a conical base to an upright peripheral wall. The device must be partially submerged before it will operate. Also, hand cranking is not an accurate method by which consistent centrifugal forces are produced. The pan is fixed relative to the remainder of its supporting frame and therefore must be cleaned on location, as do the other apparatus already described.

A portable powered centrifugal concentrator is described by Clow et al in U.S. Pat. No. 2,858,064. Clow uses a semispherical concave bowl with an upper cylindrical rim to receive and separate material. Slots are used to receive and direct fines outwardly of coarser and lighter specific gravity tailings. Again, the bowl is substantially fixed in position on its supportive frame.

M. Schlank, in U.S. Pat. No. 2,022,926, discloses a series of riffled rotating bowls for centrifugal concentration. The bowls are fixed by bolts to their supportive rotary drives.

Another hand cranked centrifugal mining apparatus is shown in U.S. Pat. No. 942,663. This apparatus is of interest mainly because it shows the use of a renewable fabric placed within the bottom of a hand rotated dish. The fabric is intended to capture heavy minerals washed over in a slurry as the dish is rotated. Fabric naturally wears and must therefore be frequently replaced. Also, removal and replacement of the fabric and adjacent coverings is a lengthy and tedious task.

The present apparatus represents a substantial advancement in the known prior art by making use of the advantages inherent in centrifugal concentration and by eliminating the common difficulties in cleaning and readying the rotary bowl or pan for subsequent operation. It makes use of an easily removable bowl and pan insert, along with a simple and effective mechanical drive mechanism. Additional advantages are gained by the pan insert, which includes an annular flange forming a pocket in the pan for collecting fines during operation. A riffled discharge collector collects any overflow residue from the pan. The entire unit is completely portable so it may be easily transported from one site to another.

DETAILED DESCRIPTION OF A PREFERRED EMBODIMENT

Figure 1:
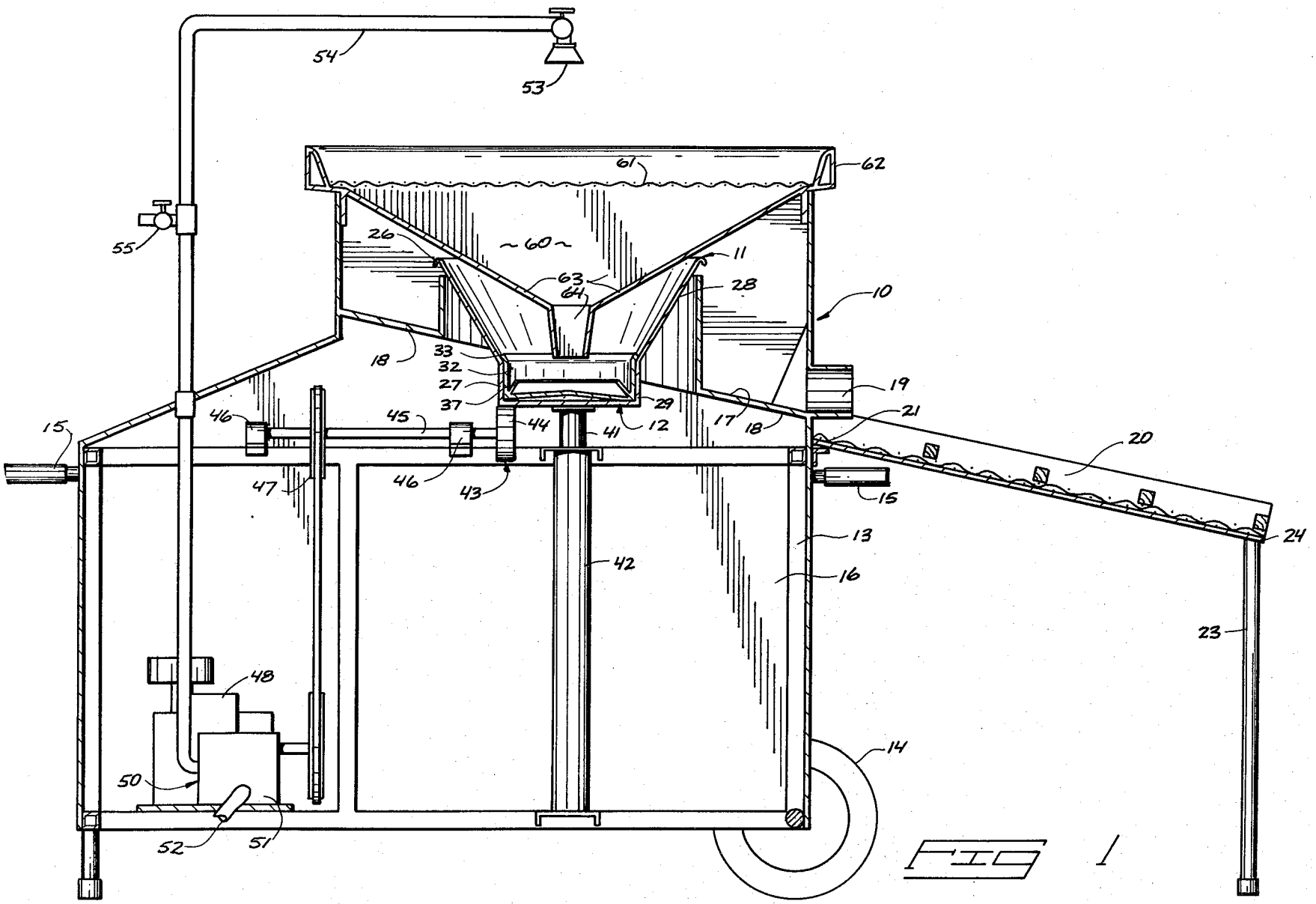
FIG. 1 is a longitudinal section view through the present concentrator.

The present concentrator is indicated in FIG. 1 of the accompanying drawings by the reference numeral 10. The concentrator 10 is provided as a portable device for separating heavy specific gravity material such as valuable minerals (gold, silver, etc.,) from a gangue or slurry by centrifugal concentration. To this end, a bowl 11 is rotated about a central upright axis so material received thereby is forced radially outward of the axis and up the walls of the bowl. Heavier material will collect within a removable pan 12 supported in the bottom of the bowl.

The present concentrator 10 preferably includes a rigid supportive frame 13. The frame 13 is preferably mounted to at least one set of wheels 14 that facilitate hand transport of the concentrator from one area to another. Handles 15 project longitudinally from opposite ends of the frame to further facilitate handling and transport.

The frame 13 is preferably covered by a sheet metal housing 16 to protect the internal elements from the environments and to protect the operator from the various internal moving parts. The housing 16 includes an integral, internal spillway 17 that surrounds the bowl 11. The spillway includes an inclined floor 18 that leads to a discharge spout 19. Tailings are received from the bowl by the spillway 17 and directed along the floor 18 to discharge spout 19, where they drain onto an elongated riffle plate 20. The plate 20 is of a relatively standard form, having one end 21 removably mounted to the frame directly below the spout 19 and a remote end 24 either supported on the ground surface or on pivoted legs 23 as shown in FIG. 1. The riffle plate is provided to catch runover material that can contain the heavy "fines" that may be discharged when the pan 12 becomes full of concentrate.

Figure 2:
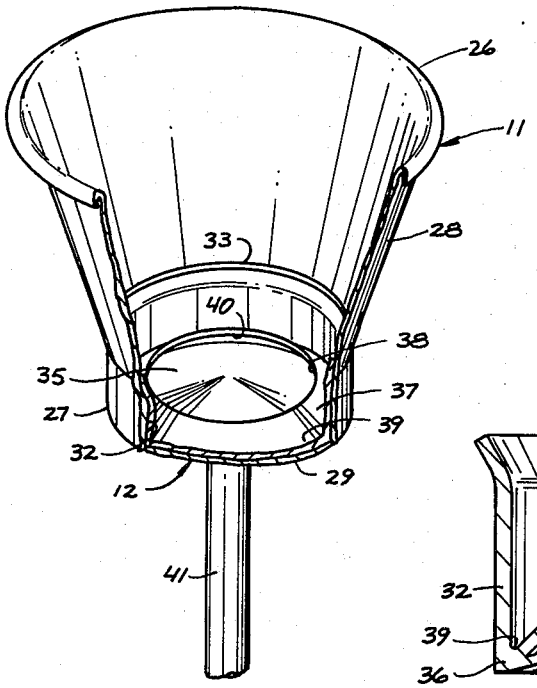
FIG. 2 is a fragmentary pictorial view of the bowl and pan of the present invention.

The bowl 11 is shown in substantial detail by FIGS. 1 and 2. The bowl is formed in a frusto-conical configuration about the upright central axis. It includes an enlarged open end 26 at a top side and a reduced closed end 27 at a bottom side. The enlarged open end 26 is circular as is the closed end 27. Both ends are centered on the upright control axis. A continuous wall 28 extends between the ends 26 and 27. The wall includes an indentation 29 adjacent the reduced closed end 27 that represents a substantially cylindrical transition from the frusto-conical configuration of the remainder of the wall. Indentation 29 is used to receive the removable pan 12.

Figure 3:
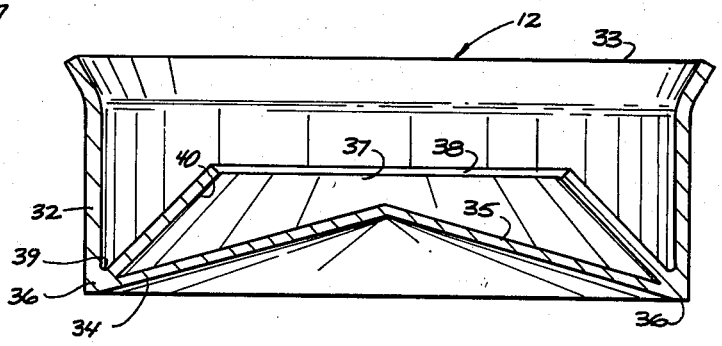
FIG. 3 is an enlarged elevational midsection view of the removable pan for the present concentrator.

The pan 12 is shown in substantial detail in FIG. 3. Pan 12 includes a substantially cylindrical wall 32 having an outwardly flared top edge 33. The wall 32 and top edge 33 are complementary to the indentation 29 at the bottom of bowl 11. The pan will therefore fit within the indentation with its wall 32 engaging the bowl wall 28. It is intended that the tolerance between the outside diameter of pan 12 and the inside diameter at the indentation 29 be sufficiently close to enable a slidable engagement of the pan within the indentation without permitting material to collect between the pan walls and adjacent bowl wall.

The wall 32 of the pan extends from the top edge 33 to a closed bottom 34. The bottom 34 includes an upwardly convex surface 35 (preferably conical) that is centered on the upright axis of the bowl. The convex surface will therefore crest at the central axis. Material fed into the bowl will be guided radially outward by the convex surface toward the pan wall 32.

The annular juncture of the pan wall 32 and closed bottom 34 is indicated at 36. An annular flange 37 is provided within the pan 12 at the juncture 36 as means for forming an annular pocket within the pan adjacent the juncture 36 of wall 32 and bottom wall 34. The flange 37 is preferably integral with the pan structure to retain its specific angular relationship with respect to the pan wall 32 and convex surface 35. The flange 37 includes a reduced top peripheral edge 38 that is spaced inwardly from the wall 32 and elevationally above the convex surface 35. The flange 37 also includes an enlarged bottom peripheral edge 39 that is secured to the pan at the juncture 36. The connection between the flange 37 and pan 12 is preferably permanent and is made by welding or other appropriate means of attachment.

The annular flange 37, between edges 38 and 39, includes a surface 40 that faces the convex surface 35. It is the area situated between the surface 40 and convex surface 35 that represents an annular pocket in which heavy concentrate is collected during operaton of the present concentrator. Such concentrates are collected as the bowl and pan are rotated about the upright central axis.

Rotation of the bowl and pan is allowed by a bearing means that includes an upright shaft 41 that is fixed to the bowl 11 and extends coaxial with the central upright axis. The shaft 41 is received by an upright tube 42 (FIG. 1) on the frame. The tube is secured to the frame for loosely receiving the shaft 41. The tube 42 provides no elevational support for the bowl or shaft but merely holds the bowl and shaft for free rotation about the upright central axis.

Figure 4:
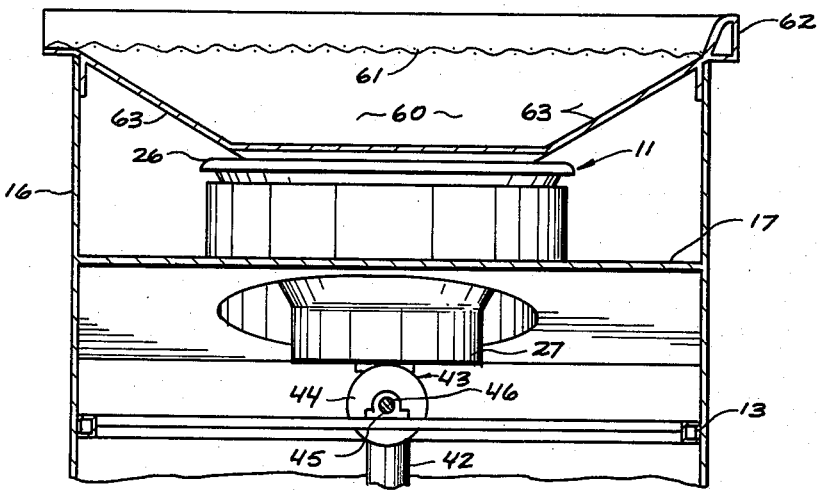
FIG. 4 is a sectional view taken along line 4—4 in FIG. 1.

The bowl and enclosed pan are rotated about the upright central axis by a drive means generally indicated at 43 (FIGS. 1 and 4). More specifically, the drive means 43 may include a wheel 44 that contacts the bowl 11 at its bottom closed end 27 to both support the bowl elevationally and rotate it about its central upright axis. The wheel 44 is preferably rubber with its circular exterior surface frictionally engaging a matching annular rim provided along the bottom surface of the bowl. The wheel 44 is mounted on an axle shaft 45. Shaft 45, in turn, is rotatably journalled in spaced bearings 46 on the frame 13. A pulley linkage 47 interconnects the axle shaft 45 with an engine 48. The engine functions to drive the shaft and rotate the wheel. The rotating wheel 44, due to its frictional engagement with the bowl, will cause corresponding rotation of the bowl about its central axis.

Material delivered to the bowl is preferably mixed with water to form a "slurry". To this end, a water supply means 50 is provided for delivering water to the bowl. The water supply means 50 may include a conventional pump 51 (FIG. 1) connected by appropriate pulley linkage to the engine 48. The pump 51 may include an appropriate intake hose 52 that can be extended to an adjacent supply of water. The pumped water is delivered to a sprinkler head 53 that is situated above the open end of bowl 11 by a relatively rigid discharge pipe 54. A secondary discharge 55 may be provided in the form of a spigot attached to the discharge pipe 54. Another hose can be connected to the secondary discharge 55 for supplying water to adjacent areas for cleaning equipment, fire prevention, domestic use, etc.

Interposed between the sprinkler 53 and bowl 11 is a hopper and screen mechanism that is shown in section by FIGS. 1 and 4. The hopper is indicated at 60 and the screen at 61. The screen and hopper are provided to receive material, screen it to a selected size and deliver it into the bowl along the central upright axis so it will first be received on the convex surface of the pan 12.

The hopper 60 includes a peripheral rectangular frame 62 that is removably positioned by the housing 16 over the bowl 11. The hopper frame 62 supports the screen 61 in a horizontal orientation on the concentrator frame 13 but can be easily removed from the frame to allow free access to the bowl and pan 11 and 12. The hopper frame 62 may be specifically designed to prevent material discharge from the enlarged open end 26 of the bowl outwardly of the housing. This represents a safety factor since material discharged from the bowl is thrown with possibly considerable force against the surrounding walls of the housing. The hopper frame 62 prevents escape of any thrown material from the housing. Instead, the discharged material flows down the housing walls onto the tilted floor 18 and subsequently is directed outwardly through the discharge spout 19.

The hopper 60 includes downwardly converging walls 63 that may be either conical or pyramidal in configuration. However formed, the wall 63 converges on the central upright axis to a discharge spout 64 (FIG. 1) that is centered on the upright axis and is situated fairly closely adjacent the crest of the convex surface 35 on pan 12.

During operation, rough gravel, sand, pebbles, etc., is placed on the screen 61 by use of shovels or buckets. The engine 48 is started and water is pumped through the sprinkler 53 against the deposited material. The water washes finer material through the screen mesh and onto the converging walls of the hopper. The remaining large particulates are either scraped off or otherwise discarded by hand picking. The sized material escaping downwardly through the screen 61 is delivered by the hopper wall 63 downwardly through the centered discharge spout 64 so that it will drop directly on the convex surface 35 of the pan 12.

The bowl and pan 12 rotate continuously as the engine 48 operates. Therefore, the slurry (the received water and sized material mixture) is received on the rotating convex surface 35. The nature of the upwardly convex surface is such that the slurry is directed radially outward to contact the pan wall and annular flange 37. The material will migrate through the pocket between the flange 37 and surface 35 and on up and outwardly along the bowl wall 28 until it overflows the open end 26. This discharged material may be considered tailings. The heavier concentrate will remain, due to its heavier specific gravity, within the confines of the annular pocket between flange 37 and convex surface 35.

The tailings are discharged from the bowl into the spillway 17. They drop from the rim of the bowl directly onto the inclined floor 18 or are projected by centrifugal force against the spillway walls. Either way, the tailings will be collected along the spillway floor 18 and directed outwardly through the discharge spout 19. The tailings are received from the discharge spout along the riffle plate 20 where very fine heavy particulates may be collected.

After sending a selected amount of material through the present concentrator, the operator may desire to check the contents of the pan 12. This is done by shutting down the engine 48 and removing the hopper and attached screen from the housing. The operator can reach down into the bowl and lift out the pan 12. Visual examination can determine quickly and easily the content of the pan. The pan can be emptied by shaking or scraping the annular pocket free of concentrated material. The pan can then be replaced within the indentation 29. The engine can be restarted for additional material to be processed.

The present apparatus as shown and described can be constructed of relatively lightweight material, and, due to the wheeled support and handles, is very easily transported from one location to another. Therefore, if the operator does not find a desired concentrate of heavy minerals at one area, the device can be easily transported to more productive areas. The lightweight materials forming the present concentrator further facilitate loading and unloading of the device into a truck or station wagon for further transport.

It has been found by experience that the present concentrator functions substantially more quickly and efficiently than the conventional hand panning devices. Experimental use has indicated that approximately 150 pans can be processed through the period of an hour where only approximately 15 pans can be processed by hand.

The above description and attached drawings are given by way of example to set forth a preferred form of the present invention. The scope of the invention is, however, more precisely set forth by the following claims.

What is claimed is:

1. A concentrator for heavy particulates, comprising:

a frame;

an upright frusto-conical bowl within the frame, formed about an upright center axis and having an enlarged open upper end and a reduced closed bottom end centered on the axis;

means mounting the bowl to the frame for free rotation about the center axis;

drive means for rotating the bowl about the center axis;

a hopper on the frame feeding downwardly into the bowl, having an open receiving end above the open end of the bowl and a discharge centered on the center axis within the bowl;

water supply means associated with the drive means for delivering water to the bowl;

a pan removably supported at the bottom of the bowl, having upright peripheral side walls leading from an open top end to a closed bottom end;

wherein the closed bottom end of the pan includes an upwardly facing convex surface having a crest-centered on the center axis; and an annular flange of frusto-conical configuration centered on the center axis, having an enlarged bottom peripheral edge engaging the pan adjacent the juncture of the convex surface and upright peripheral side walls, and a reduced top peripheral edge spaced above the convex surface.

2. The concentrator as defined by claim 1 wherein the drive means includes a driven friction wheel on the frame for frictionally engaging and supporting the bowl on the frame and for rotating the bowl about the center axis.

3. The concentrator as defined by claim 1 wherein the bearing means includes an upright shaft fixed to the bowl and depending therefrom on the center axis and a sleeve on the frame loosely receiving the shaft.

4. The concentrator as defined by claim 1 further comprising:

a housing on the frame at least partially enclosing the bowl; and an inclined spillway formed by the housing around the top enlarged open upper end of the bowl leading to a discharge spout.

5. The concentrator as defined by claim 4 further comprising:

an elongated riffle plate having one end removably mounted to the frame directly beneath the discharge spout of the housing and a remote end adapted elevationally below the one end.

6. The concentrator as defined by claim 1 further comprising screen means on the hopper spanning the open receiving end thereof for screening particulates to a selected size range.

7. The concentrator as defined by claim 6 wherein the water supply means includes a sprinkler head positioned over the screen means for directing a spray of water down into the hopper through the screen.

8. A concentrator for heavy particulates, comprising:

a frame;

a bowl on the frame having an open upper end defined by a continuous peripheral wall and a closed bottom end defined by a horizontal bottom wall;

bearing means releasably mounting the bowl to the frame for free rotational movement about an upright center axis;

drive means releasably engaging the bowl for rotating the bowl about the center axis;

a pan releasably received within the bowl and having a continuous peripheral upright wall complementary to the bowl wall adjacent the closed bottom thereof, said upright wall extending axially from an open top edge to a horizontal bottom wall spanning the pan at a bottom end thereof; and flange means within the pan forming an annular pocket within the pan adjacent the juncture of the peripheral wall of the pan and its bottom wall.

9. The concentrator as defined by claim 8 further comprising hopper means on the frame for receiving particulate material and delivering it onto the horizontal bottom wall of the pan.

10. The concentrator as defined by claim 8 wherein the bottom wall of the pan is convex in the direction of the open top edge thereof.

11. The concentrator as defined by claim 8 wherein the drive means includes a friction wheel releasably engaging the bowl and rotatable against the bowl to cause corresponding rotation of the bowl about the bowl axis.

12. The concentrator as defined by claim 8 further comprising water supply means for delivering a stream of water into the bowl.

* * * * *